US007370613B2

(12) United States Patent
Lawrence et al.

(10) Patent No.: US 7,370,613 B2
(45) Date of Patent: May 13, 2008

(54) ECCENTRIC CRANK VARIABLE COMPRESSION RATIO MECHANISM

(75) Inventors: Keith Edward Lawrence, Kobe (JP); William Elliott Moser, Peoria, IL (US); Stephan Donald Roozenboom, Washington, IL (US); Kevin Jay Knox, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 10/998,895

(22) Filed: Nov. 30, 2004

(65) Prior Publication Data

US 2006/0112911 A1 Jun. 1, 2006

(51) Int. Cl.
*F02B 75/04* (2006.01)

(52) U.S. Cl. ..... 123/48 B

(58) Field of Classification Search ..... 123/48 B, 123/48 R, 78 F, 78 R, 78 E, 197.4
See application file for complete search history.

(56) References Cited

U.S. PATENT DOCUMENTS 5,562,068 A * 10/1996 Sugimoto et al. ..... 123/48 B
6,247,430 B1 6/2001 Yapici
6,443,106 B1 * 9/2002 Pischinger et al. ..... 123/48 B
6,443,107 B1 9/2002 Mendler
6,588,384 B2 7/2003 Yapici
6,665,605 B2 * 12/2003 Boyer et al. ..... 701/103
7,032,566 B2 4/2006 Cavanagh et al.
7,185,616 B2 3/2007 Roozenboom

FOREIGN PATENT DOCUMENTS

EP 1245803 A1 * 10/2002

OTHER PUBLICATIONS

RD382001A, Feb. 1996, RD.*

* cited by examiner

*Primary Examiner*—Stephen K. Cronin
*Assistant Examiner*—Hyder Ali
(74) *Attorney, Agent, or Firm*—Finnegan, Henderson, Farabow, Garrett & Dunner

(57) ABSTRACT

A variable compression ratio mechanism for an internal combustion engine that has an engine block and a crankshaft is disclosed. The variable compression ratio mechanism has a plurality of eccentric disks configured to support the crankshaft. Each of the plurality of eccentric disks has at least one cylindrical portion annularly surrounded by the engine block. The variable compression ratio mechanism also has at least one actuator configured to rotate the plurality of eccentric disks.

32 Claims, 4 Drawing Sheets

ECCENTRIC CRANK VARIABLE COMPRESSION RATIO MECHANISM

U.S. GOVERNMENT RIGHTS

This invention was made with government support under the terms of Contract No. DE-FC05-00OR-22806 awarded by the Department of Energy. The government may have certain rights in this invention.

TECHNICAL FIELD

The present disclosure relates generally to a variable compression ratio mechanism and, more particularly, to a variable compression ratio mechanism having an eccentric crank.

BACKGROUND

Engines, including diesel engines, gasoline engines, natural gas engines, and other engines known in the art, may exhaust a complex mixture of air pollutants. The air pollutants may be composed of gaseous compounds, which may include nitrogen oxides, and solid particulate matter, which may include unburned hydrocarbon particulates called soot.

Due to increased attention on the environment, exhaust emission standards have become more stringent. The amount of air pollutants emitted from an engine may be regulated depending on the type of engine, size of engine, and/or class of engine. One method that has been implemented by engine manufacturers to comply with the regulation of particulate matter exhausted to the environment has been to develop new engines, which dynamically tailor the compression ratio of the engine to reduce exhaust emissions while allowing for efficient operation of the engine under a range of conditions.

One example of dynamically changing the compression ratio of an engine is described in U.S. Pat. No. 6,247,430 (the '430 patent), issued to Yapici on Jun. 19, 2001. The '430 patent describes an internal combustion engine having a compression ratio setting device with a plurality of eccentric rings surrounding a crankshaft. The compression ratio setting device also includes two-piece ring-supporting bearing housings that are supported within the cylinder block of the engine. The compression ratio setting device further includes a single centralized ring turning assembly that adjusts the angular position of the eccentric rings relative to the ring-supporting bearing housings to radially shift the crankshaft, whereby an upper dead center position of pistons connected to the crankshaft is altered for varying the compression ratio of the internal combustion engine.

Although the compression ratio setting device of the '430 patent may alter the compression ratio of the internal combustion engine, it may be complex and may have insufficient strength for high power density applications. In particular, because the single centralized ring supporting housing is two piece, additional parts, manufacturing processes, and assembly processes may be required to produce an engine incorporating the compression ratio setting device of the '430 patent. Further, because the ring supporting housing is two piece, the ring supporting housing may be less adequate to resist high power density loading than if the ring supporting housing were a single integral piece.

In addition, because the compression ratio setting device of the '430 patent utilizes a single centralized ring turning assembly, the design flexibility of the internal combustion engine may be limited. Specifically, the single ring turning assembly is large in order to resist operational loading. The large size of the single ring turning assembly may consume open design space within the engine, thereby limiting the space that may be occupied by neighboring systems or components. Further, because the compression ratio setting device of the '430 patent utilizes a single ring turning assembly, the ring turning assembly must be centrally located to balance loading on the compression ratio setting device. This requirement to centrally locate the ring turning assembly further limits design flexibility of the internal combustion engine employing the compression ratio setting device.

The disclosed variable compression ratio mechanism is directed to overcoming one or more of the problems set forth above.

SUMMARY OF THE INVENTION

In one aspect, the present disclosure is directed to a variable compression ratio mechanism for an internal combustion engine that has an engine block and a crankshaft. The variable compression ratio mechanism includes a plurality of eccentric disks configured to support the crankshaft. Each of the plurality of eccentric disks has at least one cylindrical portion annularly surrounded by the engine block. The variable compression ratio mechanism also includes at least one actuator configured to rotate the plurality of eccentric disks.

In another aspect, the present disclosure is directed to a method of changing a compression ratio of an internal combustion engine having an engine block and a crankshaft. The method includes supporting the crankshaft with a plurality of eccentric disks that each have at least one cylindrical portion annularly surrounded and supported by the engine block. The method also includes rotating the plurality of eccentric disks.

DETAILED DESCRIPTION

Figure 1:
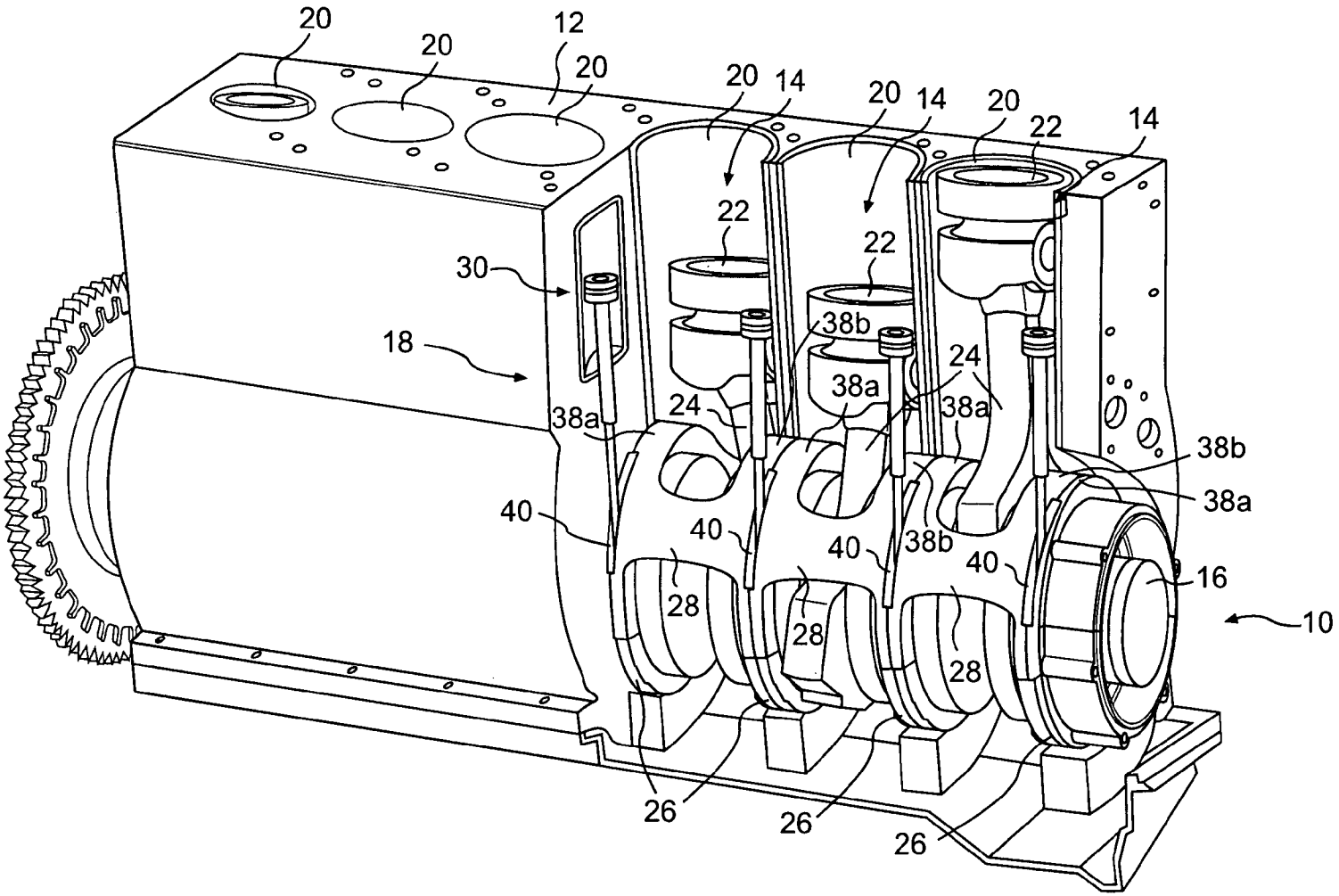
FIG. 1 is a cut-away view illustration of an exemplary disclosed internal combustion engine.

An exemplary internal combustion engine 10 is illustrated in FIG. 1. Internal combustion engine 10 is depicted and described as a diesel engine. However, it is contemplated that internal combustion engine 10 may be any other type of internal combustion engine, such as, for example, a gasoline or natural gas engine. Internal combustion engine 10 may include an engine block 12, a plurality of piston assemblies 14 pivotally connected to a crankshaft 16, and a variable compression ratio mechanism 18.

Engine block 12 may be a central structural member defining a plurality of cylinders 20. One of piston assemblies 14 may be slidably disposed within each of cylinders 20. It is contemplated that internal combustion engine 10 may include any number of cylinders 20 and that cylinders 20 may be disposed in an "in-line" configuration, a "V" configuration, or any other conventional configuration.

Each piston assembly 14 may be configured to reciprocate between a bottom-dead-center (BDC) position, or lowermost position within cylinder 20, and a top-dead-center (TDC) position, or upper-most position within cylinder 20. In particular, each piston assembly 14 may include a piston crown 22 pivotally connected to a connecting rod 24, which is in turn pivotally connected to crankshaft 16. Crankshaft 16 of internal combustion engine 10 may be rotatably disposed within engine block 12 and each piston assembly 14 maybe coupled to crankshaft 16 so that a sliding motion of each piston assembly 14 within each cylinder 20 results in a rotation of crankshaft 16. Similarly, a rotation of the crankshaft 16 may result in a sliding motion of piston assemblies 14. As crankshaft 16 rotates 180 degrees, piston crown 22 and linked connecting rod 24 move through one full stroke between BDC and TDC. Internal combustion engine 10 may be a four stroke engine, wherein a complete cycle includes an intake stroke (TDC to BDC), a compression stroke (BDC to TDC), a power stroke (TDC to BDC), and an exhaust stroke (BDC to TDC). It is also contemplated that internal combustion engine 10 may alternatively be a two stroke engine, wherein a complete cycle includes a compression/exhaust stroke (BDC to TDC) and a power/exhaust/intake stroke (TDC to BDC).

Variable compression ratio mechanism 18 may include numerous components that cooperate to affect radial translation of crankshaft 16. In particular, variable compression ratio mechanism 18 may include a plurality of eccentric disks 26 connected to each other by a webbing 28, and a fluid actuator 30 associated with each eccentric disk 26.

Figure 2:
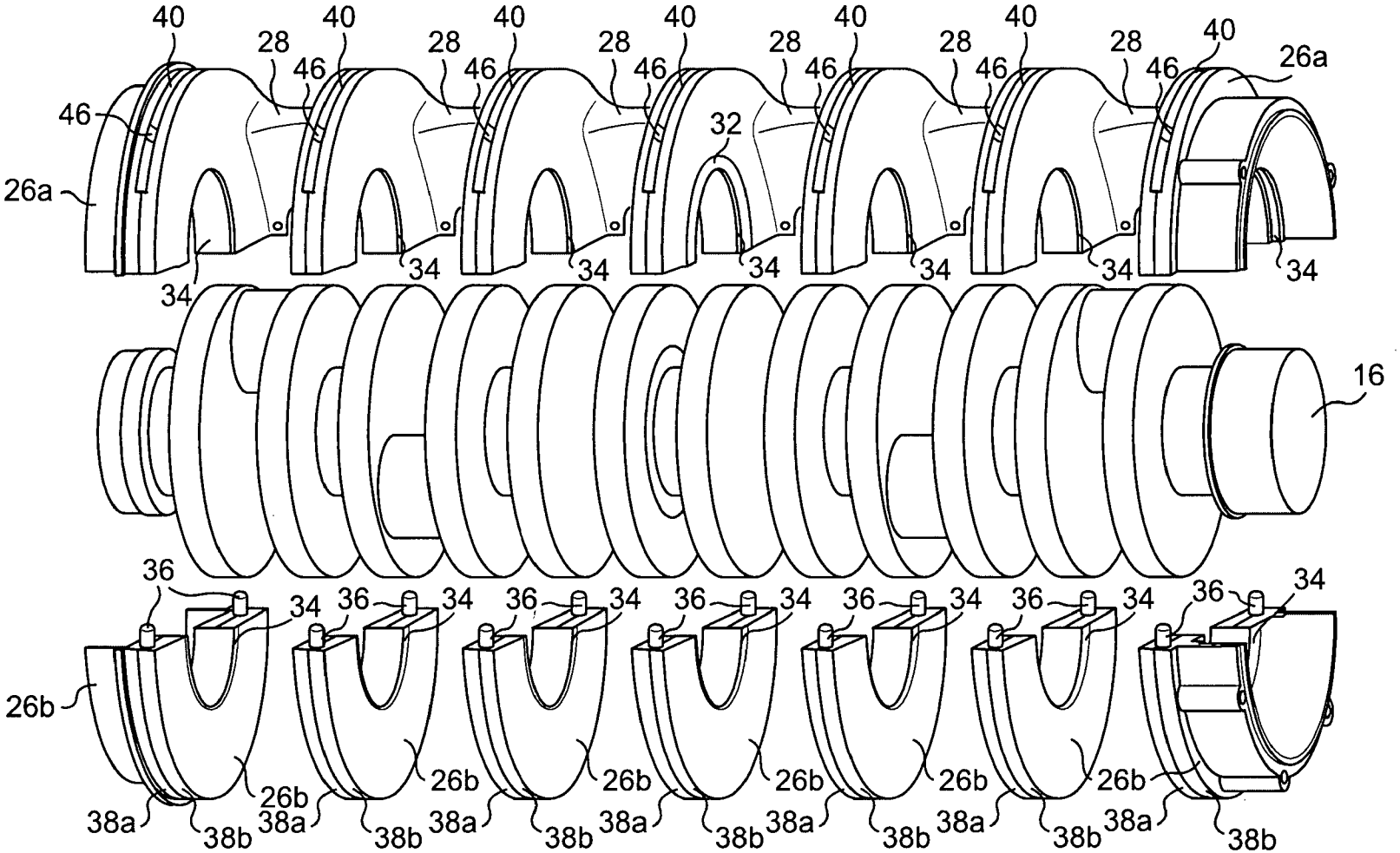
FIG. 2 is an exploded view illustration of an exemplary disclosed eccentric ring/crankshaft assembly for the internal combustion engine of FIG. 1.

As illustrated in FIG. 2, each eccentric disk 26 may include a first half 26*a* and a second half 26*b* that, when assembled, enclose a crankshaft-supporting bearing 34. Second half 26*b* may include one or more press-fitted alignment pins 36 that are configured to align first half 26*a* with second half 26*b* during assembly. Alignment pins 36 may include slip-fit tolerances relative to bores (not shown) within first half 26*a* to facilitate assembly of eccentric disk 26. It is contemplated that alignment pins may alternatively be press-fitted into first half 26*a* and slip-fitted into second half 26*b*, press-fitted into both halves, or slip-fitted into both halves, if desired. As illustrated in the cross-section view of FIG. 3, one or more fasteners 39 may also be included within each eccentric disk 26 to retain first half 26*a* to second half 26*b*.

Each of eccentric disks 26 may include two opposing cylindrical portions 38*a*, 38*b* (referring to FIG. 2) that are completely surrounded and supported by engine block 12. A channel 40 may be disposed between the two opposing cylindrical portions 38*a*, 38*b* on a portion of the outer periphery of each eccentric disk 26 to provide clearance for fluid actuator 30.

Figure 3:
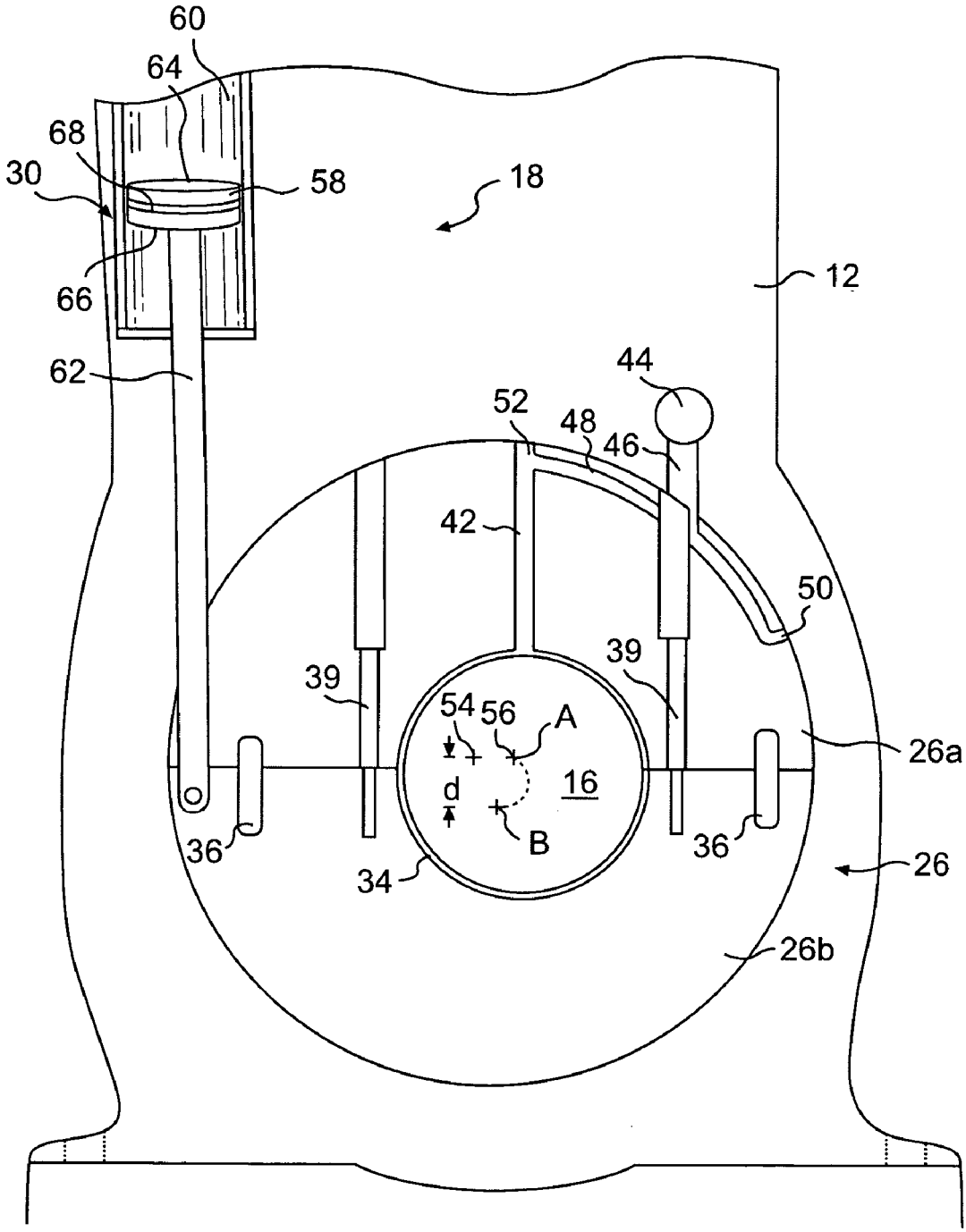
FIG. 3 is a cut-away view illustration of a variable compression ratio mechanism for the internal combustion engine of FIG. 1.

As illustrated in FIG. 3, crankshaft-supporting bearings 34 may be configured to receive lubrication during operation of internal combustion engine 10. In particular, a bore 42 within first half 26*a* of each eccentric disk 26 may fluidly communicate a manifold 44 with each crankshaft-supporting bearing 34 by way of fluid passageways 46 and 48. In addition, lubrication may be provided to the interface between eccentric disks 26 and engine block 12 by way of lubrication ports 50 and 52 connected to fluid passageways 46 and 48. Further, lubrication that leaks past fluid actuator 30 may be allowed to lubricate the interface between eccentric disks 26 and engine block 12. It is contemplated that additional or different lubrication passages may be included within variable compression ratio mechanism 18 for lubricating eccentric disks 26, crank supporting bearings 34, or any other component or system of internal combustion engine 10.

Rotation of eccentric disks 26 may cause crankshaft 16 to translate radially and thereby change a compression ratio of internal combustion engine 10. In particular, eccentric disks 26 may have a common rotational axis 54, while crankshaft 16 may have a rotational axis 56 that is, radially removed from common rotational axis 54. As eccentric disks 26 are rotated about common rotational axis 54, the position of rotational axis 56 may move from, for example, position "B" illustrated in FIG. 3, through an arc to position "A". A distance "d" is the vertical translation of crankshaft 16. This vertical translation increases the BDC and TDC positions of piston assemblies 14 by amount "d relative to engine block 12, when moving from position "B" to position "A", thereby reducing a "squish" volume (increasing the squish volume when moving from position "A" to position "B")associated with each piston. Because the displacement volume of piston assemblies 14 within cylinders 20 remains the same and the squish volume is reduced when crankshaft 16 moves from position "B" to position "A", the compression ratio is increased (decreased when moving from position "A" to position "B").

Webbing 28 (referring to FIG. 2) may connect each eccentric disk 26 to at least one other eccentric disk 26 to ensure simultaneous and equal rotation of each eccentric disk 26 and to distribute torque loads. In particular, if one eccentric disk 26 was rotated at a different time or a different amount than another eccentric disk, potentially damaging torque loads could be created and unevenly distributed through crankshaft 16.

As also illustrated in FIG. 3, actuator 30 may include a piston 58 axially aligned with and disposed within a cylinder 60 formed within cylinder block 12. One piston rod 62 may pivotally connect each piston 58 to one eccentric disk 26. Piston 58 may include two opposing hydraulic surfaces that are selectively exposed to an imbalance of force created by fluid pressure. This imbalance of force on the two surfaces may cause actuator 30 to axially move and urge the associated eccentric disk 26 to rotate. For example, a force acting on a first hydraulic surface 64 being greater than a force acting on a second opposing hydraulic surface 66 may cause piston 58 to displace downward relative to engine block 12, urging the associated eccentric disk to rotate in a counter-clockwise direction, thereby moving rotational axis 56 toward position "A". Similarly, when a force acting on second hydraulic surface 66 is greater than a force acting on first hydraulic surface 64, piston 58 may retract upward within cylinder 60, urging the associated eccentric disk 26 to rotate in a clockwise direction, thereby moving rotational axis 56 toward position "B". A sealing member 68, such as, for example, an o-ring, may be connected to the piston to restrict a flow of fluid between an internal wall of cylinder 60 and an outer cylindrical surface of piston 58.

Figure 4:
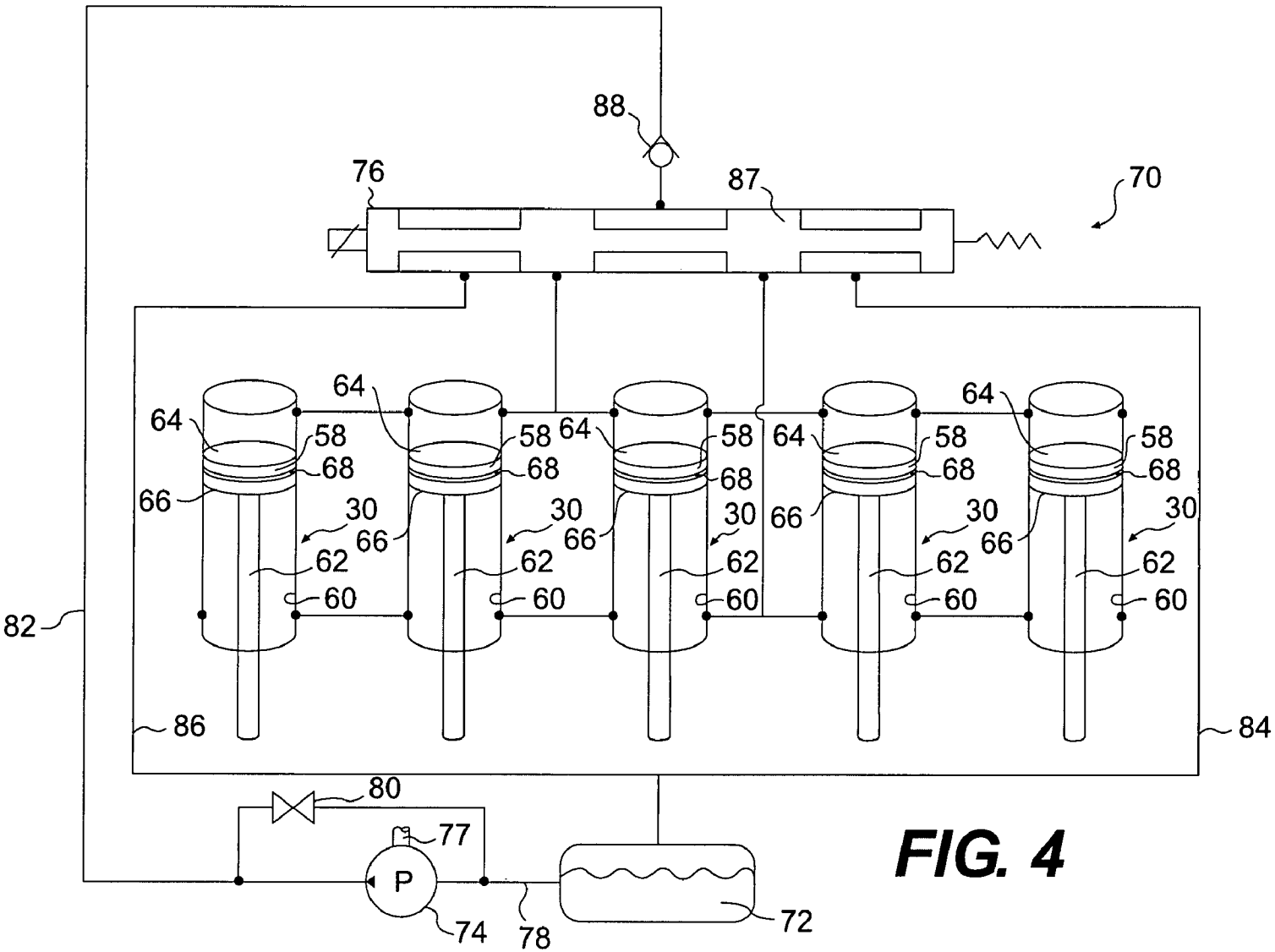
FIG. 4 is a diagrammatic illustration of the hydraulic flow for the variable compression ratio mechanism of FIG. 3.

As illustrated in FIG. 4, fluid actuator 30 may be part of a hydraulic system 70 having a plurality of fluid components that cooperate together to move actuator 30. Specifically, hydraulic system 70 may include a tank 72 holding a supply of fluid and a source 74 configured to pressurize the fluid and to direct the pressurized fluid to ail of the actuators 30 by way of a common metering valve 76. Hydraulic system 70 may also include a control system (not shown) in communication with source 74 and metering valve 76. It is contemplated that hydraulic system 70 may include additional and/or different components such as, for example, accumulators, restrictive orifices, makeup valves, pressure-balancing passageways, and other components known in the art.

Tank 72 may constitute a reservoir configured to hold a supply of fluid. The fluid may include, for example, a dedicated hydraulic oil, an engine lubrication oil, a transmission lubrication oil, or any other fluid known in the art. One or more hydraulic systems within internal combustion engine 10 may draw fluid from and return fluid to tank 72. It is also contemplated that hydraulic system 70 may be connected to multiple separate fluid tanks.

Source 74 may be connected to tank 72 by way of a fluid passageway 78 and may configured to pressurize the fluid from tank 72. Source 74 may include a pump such as, for example, a variable displacement pump, a fixed displacement pump, or any other source of pressurized fluid known in the art. Source 30 may be drivably connected to internal combustion engine 10 by, for example, a countershaft 77, a belt (not shown), an electrical circuit (not shown), or in any other suitable manner. Alternatively, source 74 may be indirectly connected to internal combustion engine 10 via a torque converter, a gear box, or in any other appropriate manner. It is contemplated that multiple sources of pressurized fluid may be interconnected to supply pressurized fluid to hydraulic system 70. A pressure relief valve 80 may be disposed between an inlet of source 74 and an outlet of source 74 to maintain a predetermined pressure in the fluid supplied to actuators 30.

Metering valve 76 may function to selectively meter pressurized fluid from source 74 to actuators 30 and to allow fluid from actuator 30 to drain to tank 72. In particular, metering valve 76 may be in fluid communication with source 74 via a fluid passageway 82 and with tank 72 via fluid passageways 84 and 86. Metering valve 76 may include a spring biased valve mechanism 87 that is solenoid actuated and configured to move between a first position at which pressurized fluid from source 74 is allowed to act against first surface 64 of piston 58 and a second position at which pressurized fluid from source 74 is allowed to act against opposing second surface 66 of piston 58. When valve mechanism 87 is in the first position fluid is simultaneously allowed to drain away from second surface 66 to tank 72, thereby creating the imbalance of force on piston 58 that causes actuator 30 to extend relative to cylinder 60. When valve mechanism 87 is in the second position, fluid is simultaneously allowed to drain away from first surface 64 to tank 72, thereby creating an imbalance of force on piston 58 that causes actuator 30 to retract within cylinder 60. A check valve 88 may be disposed between source 74 and metering valve 76 to ensure one-directional fluid flow. It is contemplated that metering valve 76 may alternatively be hydraulically actuated, mechanically actuated, pneumatically actuated, or actuated in any other suitable manner. It is further contemplated that metering valve 76 may be absent, if desired, and independent metering valves alternatively used for filing and for draining, if desired.

A thrust bearing 32 may be disposed within a central one of eccentric disks 26 and configured to engage crankshaft 16 (referring to FIG. 2). Thrust bearing 32 may limit axial movement of crankshaft 16 by linking crankshaft 16 to variable compression ratio mechanism 18. It is contemplated that additional thrust bearings 32 may be included within internal combustion engine 10 and/or that thrust bearing 32 may be disposed in one of eccentric disks 26 that is not centrally located. It is further contemplated that thrust bearing 32 may be absent, if desired, and another means for minimizing axial movement of crankshaft 16 included.

INDUSTRIAL APPLICABILITY

The disclosed variable compression ratio mechanism may be applicable to any internal combustion engine where dynamically changing a compression ratio of the internal combustion engine is desired. In addition to the compression ratio affecting exhaust emissions, the compression ratio can also affect other engine performance factors such as, for example, startability, fuel consumption, and other performance factors known in the art. The ability to dynamically vary the compression ratio of an engine may facilitate optimized operation of the engine under a variety of environmental conditions and operational situations. The operation of internal combustion engine 10 will now be explained.

During a compression stroke of internal combustion engine 10, as piston assembly 14 is moving within cylinder 20 between the BDC position and the TDC position, an air fuel mixture may be compressed into a "squish" volume in preparation for ignition, which begins the power stroke. Displacement volume (area of the piston multiplied by the stroke of the piston) divided by the "squish" volume is equivalent to the compression ratio of the engine. Higher compression ratios may allow for easier ignition of the fuel and air mixture at colder temperatures, while a lower compression ratio may allow for lower cylinder pressures at high loads. A balance of compression ratios, fuel-to-air ratio, ignition timing, and other engine parameters may facilitate exhaust emission control and optimized fuel consumption.

The compression ratio of internal combustion engine 10 may be changed by directing pressurized fluid to fluid actuators 30 (referring to FIG. 4). An imbalance of force on piston 58 of fluid actuators 30 may cause fluid actuator 30 to either extend or retract relative to cylinder 60, resulting in either a clockwise or counterclockwise rotation of eccentric disks 26. When eccentric disks 26 are rotated in a counterclockwise direction, rotational axis 56 of crankshaft 16 may translate towards position "A" (referring to FIG. 4), thereby decreasing the "squish" volume of piston assemblies 14 and increasing a compression ratio of internal combustion engine 10. When eccentric disks 26 are rotated in a clockwise direction, rotational axis 56 of crankshaft 16 may translate towards position "B", thereby increasing a "squish" volume of piston assemblies 14 and decreasing a compression ratio of internal combustion engine 10. It is contemplated that a clockwise rotation of eccentric disks 26 may alternatively result in an increase in compression ratio of internal combustion engine 10 and that a counterclockwise rotation of eccentric disks 26 may decrease a compression ratio of internal combustion engine 10.

Because all of eccentric disks 26 are completely surrounded and supported by engine block 12, variable compression ratio mechanism 18 has sufficient strength for high power density applications. Further, because the portion of engine block 12 that supports eccentric disks 26 is a single integrated part rather than a multi-piece housing, the number of parts required to produce an engine having variable compression ratio mechanism 18 is reduced, and the manufacturing processes and assembly processes required to produce internal combustion engine 10 are simplified.

Because variable compression ratio mechanism 18 includes a separate actuator for each eccentric disk, rather than one large centrally-located actuator, the space within internal combustion engine 10 is open and available for other engine systems. This open available space within internal combustion engine 10 increases the design flexibility associated with the other engine systems. Further, because variable compression ratio mechanism 18 utilizes multiple fluid actuators 30 an infinite number of balanced locations are available for locating fluid actuators 30, thereby further increasing the design flexibility of internal combustion engine 10 employing variable compression ratio mechanism 18.

It will be apparent to those skilled in the art that various modifications and variations can be made to the disclosed internal combustion engine and variable compression ratio mechanism. Other embodiments will be apparent to those skilled in the art from consideration of the specification and practice of the disclosed internal combustion engine and variable compression ratio mechanism. It is intended that the specification and examples be considered as exemplary only, with a true scope being indicated by the following claims and their equivalents.

What is claimed is:

1. A variable compression ratio mechanism for an engine having an engine block and a crankshaft, the variable compression ratio mechanism comprising:

a plurality of eccentric disks, each of the plurality of eccentric disks having at least one cylindrical portion annularly surrounded and supported by a single integrated portion of the engine block and being configured to support the crankshaft; and at least one fluid actuator directly connected to at least one of the plurality of eccentric disks and configured to rotate the plurality of eccentric disks.

2. The variable compression ratio mechanism of claim 1, wherein the at least one actuator includes a plurality of actuators, one of the plurality of actuators associated with each of the plurality of eccentric disks.

3. The variable compression ratio mechanism of claim 2, further including:

a tank;

a source of pressurized fluid; and a single common metering valve configured to selectively communicate all of the plurality of actuators with the tank and the source of pressurized fluid.

4. The variable compression ratio mechanism of claim 1, wherein a rotation of the plurality of eccentric disks causes the crankshaft to translate in a radial direction.

5. The variable compression ratio mechanism of claim 4, wherein translation of the crankshaft in the radial direction changes a compression ratio of the engine.

6. The variable compression ratio mechanism of claim 1, wherein the at least one actuator is hydraulically driven.

7. The variable compression ratio mechanism of claim 1, wherein at least one of the plurality of eccentric disks includes at least one thrust bearing configured to engage the crankshaft.

8. The variable compression ratio mechanism of claim 1, wherein each of the plurality of eccentric disks is fixedly connected to at least one other of the plurality of eccentric disks.

9. The variable compression ratio mechanism of claim 1, wherein each of the eccentric disks includes:

a first member; and a second member connectable to the first member to annularly enclose a bearing of the crankshaft.

10. The variable compression ratio mechanism of claim 9, wherein the at least one actuator extends through a channel in the first member to pivotally connect to the second member.

11. The variable compression ratio mechanism of claim 1, wherein at least one of the plurality of eccentric disks includes a second cylindrical portion annularly surrounded by the engine block, the at least one actuator disposed between the at least one cylindrical portion and the second cylindrical portion.

12. A variable compression ratio mechanism for an engine having an engine block and a crankshaft, the variable compression ratio mechanism comprising:

a plurality of eccentric disks configured to support the crankshaft, each of the eccentric disks having:

a first member having a channel; and a second member connectable to the first member to annularly enclose a bearing of the crankshaft; and at least one hydraulically driven fluid actuator configured to rotate the plurality of eccentric disks, the at least one actuator extending through the channel in the first member to pivotally connect to the second member.

13. The variable compression ratio mechanism of claim 12, wherein the at least one actuator includes a plurality of actuators, one of the plurality of actuators pivotally connected to each of the plurality of eccentric disks.

14. The variable compression ratio mechanism of claim 13, further including:

a tank;

a source of pressurized fluid; and a single common metering valve configured to selectively communicate all of the plurality of actuators with the tank and the source of pressurized fluid.

15. The variable compression ratio mechanism of claim 12, wherein operation of the at least one actuator causes the crankshaft to translate in a radial direction.

16. The variable compression ratio mechanism of claim 15, wherein translation of the crankshaft in the radial direction changes a compression ratio of the engine.

17. The variable compression ratio mechanism of claim 12, further including at least one thrust bearing configured to engage the crankshaft.

18. The variable compression ratio mechanism of claim 12, wherein each of the first members is fixedly connected to at least one other of the first members.

19. A method of changing a compression ratio of an engine having an engine block and a crankshaft, the method comprising:

supporting the crankshaft with a plurality of eccentric disks, each of the plurality of eccentric disks having at least one cylindrical portion annularly surrounded and supported by a single integrated portion of the engine block; and rotating the plurality of eccentric disks by using at least one fluid actuator attached to at least one of the plurality of eccentric disks.

20. The method of claim 19, wherein each of the eccentric disks includes a first member and a second member connectable to the first member to annularly enclose a bearing of the crankshaft, and rotating is accomplished by operating at least one actuator that extends through a channel in the first member to pivotally connect to the second member.

21. The method of claim 20, wherein the at least one actuator includes a plurality of actuators and rotating is accomplished by operating one of the plurality of actuators pivotally connected to each of the plurality of eccentric disks.

22. The method of claim 19, wherein rotating the plurality of eccentric disks causes the crankshaft to translate in a radial direction.

23. The method of claim 19, further including limiting axial movement of the crankshaft with a thrust bearing connected to at least one of the plurality of eccentric disks.

24. A method of changing a compression ratio of an engine having an engine block and a crankshaft, the method comprising:

supporting the crankshaft with a plurality of eccentric disks, each of the eccentric disks including a first member and a second member connectable to the first member to annularly enclose a bearing of the crankshaft; and operating at least one hydraulically driven fluid actuator that extends through a channel in the first member to pivotally connect to the second member to rotate the plurality of eccentric disks.

25. The method of claim 24, wherein the at least one actuator includes a plurality of actuators and rotation of the plurality of eccentric disks is accomplished substantially simultaneously by operating each of the plurality of actuators.

26. The method of claim 24, wherein rotating the plurality of eccentric disks causes the crankshaft to translate in a radial direction.

27. The method of claim 24, further including limiting axial movement of the crankshaft with a thrust bearing connected to at least one of the plurality of eccentric disks.

28. An engine, comprising:

an engine block defining a plurality of cylinders;

a crankshaft rotatably disposed within the engine block;

a piston slidably disposed within each of the plurality of cylinders and pivotally connected to the crankshaft; and a variable compression ratio mechanism having:

a plurality of eccentric disks, each of the plurality of eccentric disks being fixedly connected to at least one other of the plurality of eccentric disks, being configured to support the crankshaft, and having:

a first member;

a second member connectable to the first member to annularly enclose a bearing of the crankshaft; and at least one cylindrical portion annularly surrounded and supported by a single integrated portion of the engine block;

at least one fluid actuator extending through a channel in the first member to pivotally connect to the second member and being configured to rotate the plurality of eccentric disks, the rotation of the plurality of eccentric disks causing the crankshaft to translate in a radial direction, thereby changing a compression ratio of the engine; and at least one thrust bearing configured to engage the crankshaft.

29. The engine of claim 28, wherein the at least one actuator includes a plurality of actuators, one of the plurality of actuators associated with each of the plurality of eccentric disks.

30. The engine of claim 29, further including:

a tank;

a source of pressurized fluid; and a single common metering valve configured to selectively communicate all of the plurality of actuators with the tank and the source of pressurized fluid.

31. The engine of claim 28, wherein the at least one actuator is hydraulically driven.

32. The engine of claim 28, wherein at least one of the plurality of eccentric disks includes a second cylindrical portion annularly surrounded by the engine block, the at least one actuator disposed between the at least one cylindrical portion and the second cylindrical portion.

* * * * *

UNITED STATES PATENT AND TRADEMARK OFFICE

CERTIFICATE OF CORRECTION

PATENT NO. : 7,370,613 B2
APPLICATION NO. : 10/998895
DATED : May 13, 2008
INVENTOR(S) : Lawrence et al.

It is certified that error appears in the above-identified patent and that said Letters Patent is hereby corrected as shown below:

Please correct the Claim as follows:
Column 8, lines 54–55, in claim 20, delete "rotating is accomplished by operating at least one actuator that extends" and insert -- the at least one fluid actuator extends --.

Signed and Sealed this
Twenty-third Day of August, 2011

David J. Kappos
*Director of the United States Patent and Trademark Office*